US006776750B2

(12) United States Patent
Stieler et al.

(10) Patent No.: US 6,776,750 B2
(45) Date of Patent: Aug. 17, 2004

(54) DRIVE FOR A FOLDER

(75) Inventors: Andreas Stieler, Augsburg (DE); Nils-Hendric Schall, Augsburg (DE); Karsten Stansch, Plauen (DE); Ulrich Seyffert, Syrau (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/152,259

(22) Filed: May 21, 2002

(65) Prior Publication Data

US 2002/0185022 A1 Dec. 12, 2002

(30) Foreign Application Priority Data

Jun. 9, 2001 (DE) ..... 101 28 122

(51) Int. Cl.[7] ..... B31F 1/10

(52) U.S. Cl. ..... 493/424; 493/320; 493/434; 493/435; 493/442

(58) Field of Search ..... 493/320–323, 493/424, 434, 435, 442; 74/665 L, 665 N; 101/248, 216, 183, 225

(56) References Cited

U.S. PATENT DOCUMENTS

| | | | | | |
|---|---|---|---|---|---|
| 2,022,696 | A | * | 12/1935 | Tomlin et al. | 270/5.01 |
| 3,557,692 | A | * | 1/1971 | Lee | 101/177 |
| 4,176,833 | A | * | 12/1979 | Heimlicher | 493/324 |
| 4,332,582 | A | * | 6/1982 | Hertrich | 493/424 |
| 4,568,289 | A | * | 2/1986 | Heidrich et al. | 440/3 |
| 4,861,326 | A | * | 8/1989 | Kuhner et al. | 493/359 |
| 5,065,993 | A | * | 11/1991 | Reponty | 270/49 |
| 5,080,338 | A | * | 1/1992 | Belanger et al. | 270/6 |
| 5,117,753 | A | * | 6/1992 | Mamberer | 101/225 |
| 5,201,701 | A | * | 4/1993 | Roettger et al. | 493/425 |
| 5,222,409 | A | * | 6/1993 | Dalakian | 74/479.01 |
| 5,242,367 | A | | 9/1993 | Marmin | 493/359 |
| 5,305,993 | A | * | 4/1994 | Staeb | 270/37 |
| 5,309,833 | A | * | 5/1994 | Guaraldi | 101/217 |
| 5,309,834 | A | * | 5/1994 | Koch | 101/248 |
| 5,429,579 | A | * | 7/1995 | Nishihara | 493/359 |
| 5,443,437 | A | * | 8/1995 | Mack | 493/359 |
| 5,494,270 | A | * | 2/1996 | Laubscher | 270/49 |
| 5,522,586 | A | * | 6/1996 | Bennett et al. | 270/8 |
| 5,676,630 | A | | 10/1997 | Mayr | 493/424 |
| 5,697,881 | A | * | 12/1997 | Nishihara | 493/429 |
| 5,810,152 | A | * | 9/1998 | Spada | 198/478.1 |
| 5,927,195 | A | * | 7/1999 | Volz et al. | 101/183 |
| 6,343,549 | B1 | * | 2/2002 | Tokiwa | 101/248 |
| 6,367,792 | B1 | * | 4/2002 | Chagnon | 270/5.02 |
| 6,550,385 | B1 | * | 4/2003 | Colin et al. | 101/228 |

FOREIGN PATENT DOCUMENTS

| | | | | |
|---|---|---|---|---|
| DE | 4426987 A1 | * | 2/1996 | B41F/13/60 |
| DE | 19509947 A1 | * | 9/1996 | B41F/13/54 |
| DE | 19525169 A1 | * | 9/1996 | B41F/5/00 |
| DE | 19755428 A1 | * | 6/1999 | B41F/13/62 |
| EP | 0 531 648 | | 3/1993 | B65H/45/16 |

* cited by examiner

*Primary Examiner*—Stephen F. Gerrity
*Assistant Examiner*—Hemant M. Desai
(74) *Attorney, Agent, or Firm*—Cohen, Pontani, Lieberman & Pavane

(57) ABSTRACT

A low-oscillation and space-saving drive for a changeable format folder of a rotary printing is provided, the rotary printing machine having rotating subassemblies that can be driven, in particular a cutting cylinder, a pin folding blade cylinder, a folding jaw cylinder, a gripper folding blade cylinder, and perforating cylinders belonging to a perforating device. The drive is split up into individual subsystems, and each subsystem is assigned a controlled-position drive motor. In the event of failure of a drive motor, the drive continues to operate without functional impairment.

25 Claims, 2 Drawing Sheets

DRIVE FOR A FOLDER

BACKGROUND OF THE INVENTION

1. Field of the Invention

The invention relates to a drive for a folder of a rotary printing machine having rotating subassemblies that can be driven, in particular a cutting cylinder, a pin folding blade cylinder, a folding jaw cylinder, a gripper folding blade cylinder, and perforating cylinders belonging to a perforating device.

2. Description of the Related Art

U.S. Pat. No. 5,242,367 discloses a folder whose synchronism between the parts is brought about by pairs of gears which are in each case coupled coaxially to one another, the pairs of gears being separated from one another by means of clutches and the pairs of gears being displaced axially for the purpose of changing over the fold or setting the format, in particular adjusting the prefold.

This solution is technically complicated, requires a relatively great amount of space and, because of multiple tooth engagements, is afflicted by rotational play and threatened by wear.

U.S. Pat. No. 5,676,630 discloses a folder with format changing in which cylinder segments of the folding cylinders are rotated with respect to one another by means of two epicyclic gear mechanisms which can be adjusted in relation to each other for the purpose of changing the format.

This solution is technically complicated and, because of multiple tooth engagement, is afflicted by rotational play and threatened by wear.

DE 197 55 428 A1 shows an apparatus for adjusting the folding mechanisms on a folding cylinder of a folder, the adjustment of the cylinder elements bearing folding mechanisms being carried out with two harmonic drive mechanisms in each case connected to the cylinder elements.

The disadvantage is that the drive to the folder is not configured in a low-oscillation manner, and no influence can be exerted on the oscillations which occur.

U.S. Pat. No. 5,901,647 shows a method for the low-oscillation driving of rotating components of a folder, and a low-oscillation folder drive, in each case a motor being assigned to each rotating component, such as perforating rolls, folding jaw cylinders or longitudinal folding devices, and being connected by a form fit to the respective component.

The disadvantage is that in order to adjust the cylinder parts of each cylinder, additional mechanical elements are necessary and, in the event of failure of a motor, the control of the folder initiates a rapid stop for all the rotating subassemblies and the capping of the paper web running into the folder.

SUMMARY OF THE INVENTION

The invention is based on the object of providing a low-wear, space-saving and low-oscillation drive for a folder with changeable format, the intention being to continue to operate the folder without functional impairment in the event of failure of a motor.

This object is fulfilled by splitting up the drive of the folder into a plurality of subsystems wherein each subsystem is assigned a controlled position drive motor.

A particular advantage of the invention is that, as a result of the use of individual controlled-position drive motors on the respective function groups of the folder, such as individual drive motors on the knife cylinder, on the pin folding cylinder, on the folding jaw cylinder and on the perforating device, it is possible for the drive of a folder to be divided up into a plurality of subsystems whose drives are separated from one another.

In addition, as a result of this subdivision of the drive of a folder into a plurality of subsystems whose drives are separated from one another, the transmission of oscillations between the subsystems is minimized.

A further advantage is that the subsystems can be coupled to one another via switchable clutches.

In the event of failure of one of the drive motors, this advantageously permits further operation of the subsystem in which the drive motor has failed, by coupling this "drive-less" subsystem to at least one of the other subsystems, and therefore the serviceability of the entire folder is ensured.

Furthermore, if there is a requirement for a higher torque, for example if there is a requirement for a higher starting torque on the knife cylinder, the subsystems can optionally be coupled to one another via the clutches.

It is advantageous that the individual controlled-position drive motors are used for adjustment functions, such as prefold adjustment or changing over to other types of fold, for example changing over from parallel fold to delta fold or to Z fold and vice versa. It is therefore possible for the mechanical actuating devices providing these adjustment functions for format changing or fold adjustment to be dispensed with.

Furthermore, as a result of the use of the drive motors configured as individual drives, a division of the power in the drive can be carried out, as a result smaller drive motors can be used, which also reduces the dimensioning of the controlled electronics in a corresponding way.

It is significant that, as a result of the use of the individual drives and the subdivision of the mechanical drive train into functional groups, it is possible to exert an active influence on the dynamic system as a folder or as a folding unit via the controlled electronics of the drives. If a plurality of drive motors are used, these can be arranged in the folder in such a way that oscillations which occur are counteracted on the basis of the beneficial, that is to say oscillation-reducing, arrangement of the drive motors in the folder, as a result of which oscillation amplitudes are minimized. Likewise, fold deviations because of oscillations are minimized. Moreover, the oscillations that impair the folding quality are counteracted by the drive control of the motors.

It should also be mentioned that, during steady state operation, all the subsystems can be coupled together and, in this way, by means of defined subdivision of the total drive torque, the gear train consisting of the individual gears engaged with one another is braced. As a result, the multiple tooth engagement in the individual subsystems and in the overall drive train of the folder is no longer subject to rotational play and threatened by wear in steady state operation.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
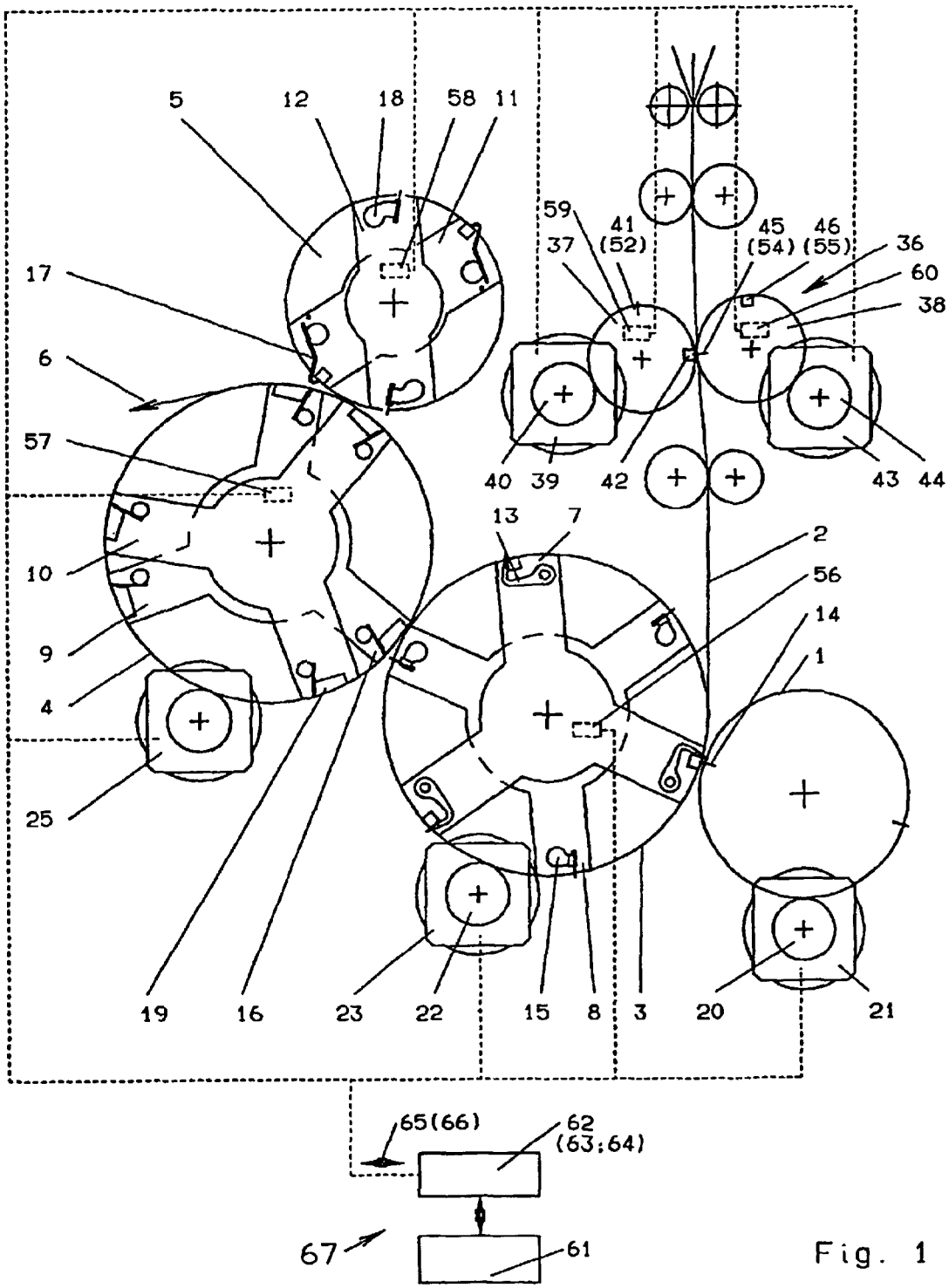
FIG. 1 shows a changeable format folder having a cutting cylinder, a pin folding blade cylinder, a folding jaw cylinder or first and second crossfold, a gripper folding blade cylinder and a perforating device for perforating the first and second crossfold.

FIG. 1 shows a cutting cylinder 1 for cutting a paper web 2 in interaction with a pin folding blade cylinder 3, downstream of which a folding jaw cylinder 4 is arranged. The pin folding blade cylinder 3, interacting with the folding jaw cylinder 4, produces a crossfold on copies cut by the cutting cylinder 1. In the event of a further crossfold, a gripper folding blade cylinder 5 cooperates with the folding jaw cylinder 4. The copies are subsequently delivered in the direction of an arrow by a sheet guide 6.

Before the cutting cylinder 1, the paper web 2 runs through a perforating device 36, for example a perforating device for cross perforation, comprising perforating cylinders 37 and 38.

The pin folding blade cylinder 3, the folding jaw cylinder 4 and the gripper folding blade cylinder 5 each comprise two cylinder parts 7 and 8; 9 and 10; 11 and 12 which can be adjusted with respect to one another. The cylinder part 7 has three rows of perforating needles 13, which interact with the cutting knives 14 of the cutting cylinder 1 and are driven by a first controlled-position drive motor 21 arranged on the cutting cylinder 1. The elements connected to the drive motor 21, the cutting cylinder 1 and the perforating part 7 of the pin folding blade cylinder 3, represent a first subsystem A of the drive of the folder (see FIG. 2).

In the event of a displacement of the fold with respect to the perforating needles 13, the cylinder part 8 with the folding blades 15 of the pin folding blade cylinder 3, and the cylinder part 9 of the folding jaw cylinder 4, fitted with folding jaws 16, has to be rotated by the same angular amount in order that the folding blades 15 can insert the products, not illustrated, between the folding jaws 16.

If a second crossfold is made, it is likewise necessary for the cylinder part 11 of the gripping folding blade cylinder 5, fitted with grippers 17, to be rotated in order that the grippers 17 can accept the products already crossfolded once from the folding jaws 16 of the cylinder part 9 of the folding jaw cylinder 4.

The cylinder part 8 fitted with folding blades 15 interacts with the cylinder part 9 fitted with folding jaws 16 and with the cylinder part 11 fitted with grippers 17, and is driven via a second controlled-position drive motor 25, which is arranged on the folding jaw cylinder 4. Alternatively, but not specifically illustrated, the drive motor 25 can also be arranged on the pin folding blade cylinder 3 or on the gripper folding blade cylinder 5.

Figure 2:
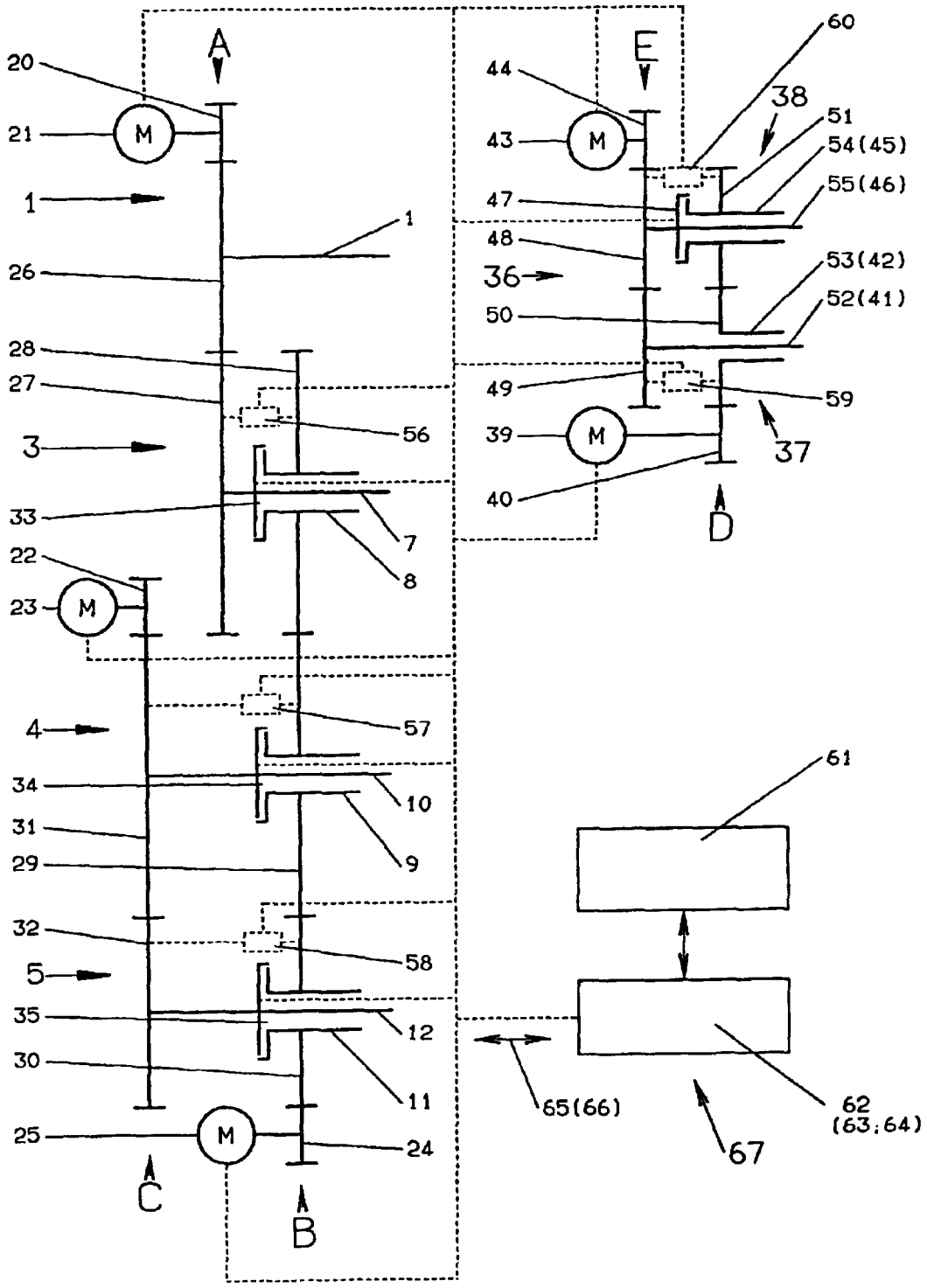
FIG. 2 shows the drive of the folding cylinders and their cylinder parts and also the perforating device in a schematic illustration.

The elements connected to the drive motor 25, the cylinder part 8 with the folding blades 15, the cylinder part 9 with the folding jaws 16 and the cylinder part 11 with the grippers 17, represent a second subsystem B of the drive of the folder (see FIG. 2).

The second crossfold is made by folding blades 18 of the cylinder part 12 of the gripper folding blade cylinder 5 in interaction with folding jaws 19 of the cylinder part 10 of the folding jaw cylinder 4, the cylinder part 10 and the cylinder part 12 being driven by a third controlled-position drive motor 23. The drive motor 23 is arranged on the pin folding blade cylinder 3. Alternatively, but not specifically illustrated, the drive motor 23 can be arranged on the folding jaw cylinder 4 or on the gripper folding blade cylinder 5.

The elements connected to the drive motor 23, the cylinder part 10 with the folding jaws and the cylinder part 12 with the folding blades 18, represent a further subsystem C of the drive of the folder (see FIG. 2).

Arranged on the perforating cylinder 37 of the perforating device 36 is a drive motor 39, which drives the perforating cylinder 37 via a drive gear 40. The perforating cylinder 37 comprises a cylinder part 52 with a perforating knife 41 and a cylinder part 53 with a perforating groove 42. Arranged on the perforating cylinder 38 of the perforating device 36 is a drive motor 43, which drives the perforating cylinder 38 via a drive gear 44. The perforating cylinder 38 comprises a cylinder part 54 with a perforating knife 45 and a cylinder part 55 with a perforating groove 46.

The perforating knife 45 of the perforating cylinder 38, arranged on the cylinder part 54, interacts with the perforating groove 42 of the perforating cylinder 37, arranged on the cylinder part 53, in order to provide a perforation for a first crossfold and, with the drive motor 39, forms a subsystem D of the drive of the folder (see FIG. 2).

The perforating knife 41 of the perforating cylinder 37, arranged on the cylinder part 52, interacts with the perforating groove 46 of the perforating cylinder 38, arranged on the cylinder part 55, in order to provide a perforation for a second crossfold and, with the drive motor 43, forms a subsystem E of the drive of the folder (see FIG. 2).

The individual subsystems A; B; C; D; E of the drive of the folder with perforating device 36 are explained in more detail in FIG. 2.

The subsystems A, B and C can be coupled to one another via clutches 33; 34; 35, and the subsystems D and E can be coupled to one another via a clutch 47.

The subsystem A is driven by the drive motor 21, which meshes via a drive gear 20 with a drive gear 26 of the cutting cylinder 1, the drive gear 26 meshes with a drive gear 27 of the cylinder part 7 of the pin folding blade cylinder 3. The drive gear 27 can be connected, via the clutch 33, to a drive gear 28 of the cylinder part 8 of the subsystem B.

The subsystem B is driven by a drive motor 25 and is connected to a gear 24. The drive gear 28 meshes with a drive gear 29 of the cylinder part 9 of the folding jaw cylinder 4, and the drive gear 29 meshes with a drive gear 30 of the cylinder part 11 of the gripper folding blade cylinder 5. The drive gear 30 can be connected to the drive gear 32 of the subsystem C via the clutch 35. The drive gear 30 meshes with the drive gear 24.

The drive gear 29 of the subsystem B can additionally be coupled, via a clutch 34, to a drive gear 31 of the cylinder part 10 of the folding jaw cylinder 4, the drive gear 31 meshing with a drive gear 22 being arranged on a drive motor 23 and being associated with the subsystem C. The drive gear 31 meshes with a drive gear 32 of the cylinder part 12 of the gripper folding blade cylinder 5.

The subsystem D comprises the drive motor 39, which meshes, via the drive gear 40, with a drive gear 50 that drives the cylinder part 53. The drive gear 50 meshes with a drive gear 51 that drives the cylinder part 54.

The subsystem E comprises the drive motor 43 which, via the drive gear 44, meshes with a drive gear 48 that drives the cylinder part 55. The drive gear 48 meshes with a drive gear 49 that drives the cylinder part 52.

The subsystems D and E can be coupled to each other via a clutch 47. In this case, the clutch 47 can be arranged on the drive gear 51 of the subsystem D and the drive gear 48 of the subsystem E and/or on the drive gear 50 of the subsystem D and the drive gear 49 of the subsystem E.

The perforating device 36 can also be configured without a clutch 47 and can be used and operated even without the folder shown.

The adjustment movements of the cylinder parts 7; 8 and 9; 10 and 11; 12, respectively, registered by sensors 56; 57; 58 during the folding adjustment, are fed to a computer 62 coupled to a memory unit 61 containing data and/or to a closed-loop control device 63 and/or to an open-loop control device 64, which, ensuring automatic fold adjustment, is connected to the drive motors 21; 23; 25 and the clutches 33; 34; 35 so as to provide signals via connecting lines. The connecting lines are illustrated in schematic form in FIG. 1 and dashed in FIG. 2.

Furthermore, the positions and adjustment movements, registered by sensors 59; 60, of the cylinder parts 52; 53; 54; 55 arranged on the perforating cylinders 37; 38 of the perforating device 36 in order to carry out the perforation for the first crossfold and, respectively, for the second crossfold are fed to the computer 62 coupled to the memory unit 61 containing data and/or to the closed-loop control device 63 and/or to the open-loop control device 64, which, carrying out automatic tracking of the perforation, is connected to the drive motors 39; 43 that drive the perforating device 36 and to the clutch 47 so as to provide signals via connecting lines. The connecting lines are illustrated in schematic form in FIG. 1 and dashed in FIG. 2.

The clutches (33; 34; 35; 47) are connected to the computer 62 so as to exchange signals 65 and data 66. Via the computer 62, the closed-loop control device 63 or the open-loop control device 64, the switchable clutches 33; 34; 35 and 47 can be activated or deactivated automatically, depending on the requirement of the torque needed or, in the event of failure of a drive motor 21; 23; 25; 39; 43, the coupling of the subsystems can be activated or deactivated automatically.

A variant not specifically illustrated would be for at least one of the subsystems A; B; C to be connected to at least one of the subsystems D; E via a further clutch.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A drive system for a folder of a rotary printing machine having rotating subassemblies that can be driven, at least one of said subassemblies having two parts which can rotate coaxially, said drive system comprising a plurality of subsystems which can be driven independently of each other, each subsystem comprising a respective controlled position drive motor for driving said each subsystem, each subsystem comprising a respective said part of at least one of said subassemblies having two parts, a plurality of clutches for coupling said subsystems to each other, each said clutch coupling said two parts of a respective said subassembly, a memory unit containing data, a computer connected to said memory unit, said computer generating output signals for said drive motors and said clutches, and means connecting said clutches to said computer for exchanging signals and data.

2. A drive system as in claim 1 wherein said clutches are switchable clutches.

3. A drive system as in claim 1 wherein said subassemblies comprise a first subassembly comprising a cutting cylinder, and a second subassembly comprising a pin-folding blade cylinder having first and second cylinder parts, said subsystems comprising a first subsystem comprising a first controlled position drive motor for driving said first subassembly and far driving said first cylinder part of said second subassembly, and a drive connection between said cutting cylinder and said first cylinder part of said second subassembly.

4. A drive system as in claim 3 wherein said subassemblies further comprise a third subassembly comprising a folding jaw cylinder having first and second cylinder parts, and a fourth subassembly comprising a gripper-folding blade cylinder having first and second cylinder parts, subsystems further comprising a second subsystem comprising a second controlled position drive motor for driving said second cylinder part of said second subassembly, and for driving said first cylinder part of said third subassembly, and for driving said first cylinder part of said fourth subassembly, a drive connection between said second cylinder part of said second subassembly and said first cylinder part of said third subassembly, and a drive connection between said first cylinder part of said third subassembly and said first cylinder part of said fourth subassembly.

5. A drive system as in claim 4 wherein said subsystems further comprise a third subsystem comprising a third controlled position drive motor for driving said second cylinder part of said third subassembly, and for driving a second cylinder part of said fourth subassembly which can be rotated coaxially with said first cylinder part of said fourth subassembly, and a drive connection between said second cylinder part of said third subassembly and said second cylinder part of said fourth subassembly.

6. A drive system as in claim 5 wherein said subassemblies further comprise a fifth subassembly comprising a perforating cylinder having a first cylinder part with a perforating groove, and a sixth subassembly comprising a perforating cylinder having a first cylinder part with a perforating knife, said subsystems comprising a fourth subsystem comprising a fourth controlled position drive motor for driving said first cylinder of said fifth subassembly, and for driving said first cylinder part of said sixth subassembly, and a drive connection between said first cylinder part of said fifth subassembly and said first cylinder part of said sixth subassembly.

7. A drive system as in claim 6 wherein said subsystems further comprise a fifth subsystem comprising a fifth controlled position drive motor for driving a second cylinder part of said fifth subassembly which is rotatable coaxially with said first cylinder part of said fifth subassembly, and for driving a second cylinder part of said sixth subassembly which is rotatable coaxially with first cylinder part of said sixth subassembly, said second cylinder part of said fifth subassembly having a perforating knife, said second cylinder part of said sixth subassembly having a perforating groove with cooperates with said perforating knife of said second cylinder part of said fifth subassembly, and a drive connection between said second cylinder part of said fifth subassembly and said second cylinder part of said sixth subassembly.

8. A drive system as in claim 7 further comprising sensors for registering adjusting movements of one of said cylinder parts in each of said second through sixth subassemblies, and for generating input signals, a memory unit containing data, and a computer which processes said input signals and said data, and which generates output signals for said drive motors.

9. A drive system as in claim 5 further comprising sensors for registering adjusting movements of one of said cylinder parts in each of said second, third, and fourth subassemblies, and for generating input signals, a memory unit containing data, and a computer which processes said input signals and said data, and which generates output signals for said drive motors.

10. A drive system as in claim 1 wherein said means connecting said clutches to said computer comprises at least one of a closed loop control device and an open loop control device.

11. A drive system as in claim 1 further comprising controlled electronics which regulate and control said drive motors, said electronics exerting an active influence on oscillations which occur in said subsystems.

12. A drive system as in claim 1 wherein said subsystems comprise drive gears which can be coupled via said clutches, said system further comprising means for distributing the total drive torque of the system over the drive motors so that mechanical tooth play between the gears is suppressed.

13. A drive system for a folder of a rotary printing machine having rotating subassemblies that can be driven, at least one of said subassemblies having two parts which can rotate coaxially, said subassemblies comprise a first subassembly comprising a cutting cylinder, and a second subassembly comprising a pin-folding blade cylinder having first and second cylinder parts, said drive system comprising:

a plurality of subsystems which can be driven independently of each other, each subsystem comprising a respective controlled position drive motor for driving said each subsystem, each subsystem comprising a respective said part of at least one of said subassemblies having two parts, said subsystems comprising a first subsystem comprising:

a first controlled position drive motor for driving said first subassembly and for driving said first cylinder part of said second subassembly, and a drive connection between said cutting cylinder and said first cylinder part of said second subassembly.

14. A drive system as in claim 13 further comprising a plurality of clutches for coupling said subsystems to each other, each said clutch coupling said two parts of a respective said subassembly.

15. A drive system as in claim 14 wherein said clutches are switchable clutches.

16. A drive system as in claim 14 further comprising:

a memory unit containing data, a computer connected to said memory unit, said computer generating output signals for said drive motors and said clutches, and means connecting said clutches to said computer for exchanging signals and data.

17. A drive system as in claim 16 wherein said means connecting said clutches to said computer comprises at least one of a closed loop control device and an open loop control device.

18. A drive system as in claim 14 wherein said subsystems comprise drive gears which can be coupled via said clutches, said system further comprising means for distributing the total drive torque of the system over the drive motors so that mechanical tooth play between the gears is suppressed.

19. A drive system as in claim 13 wherein said subassemblies further comprise a third subassembly comprising a folding jaw cylinder having first and second cylinder parts, and a fourth subassembly comprising a gripper-folding blade cylinder having first and second cylinder parts, subsystems further comprising a second subsystem comprising:

a second controlled position drive motor for driving said second cylinder part of said second subassembly, and for driving said first cylinder part of said third subassembly, and for driving said first cylinder part of said fourth subassembly, a drive connection between said second cylinder part of said second subassembly and said first cylinder part of said third subassembly, and a drive connection between said first cylinder part of said third subassembly and said first cylinder part of said fourth subassembly.

20. A drive system as in claim 19 wherein said subsystems further comprise a third subsystem comprising:

a third controlled position drive motor for driving said second cylinder part of said third subassembly, and for driving a second cylinder part of said fourth subassembly which can be rotated coaxially with said first cylinder part of said fourth subassembly, and a drive connection between said second cylinder part of said third subassembly and said second cylinder part of said fourth subassembly.

21. A drive system as in claim 20 wherein said subassemblies further comprise a fifth subassembly comprising a perforating cylinder having a first cylinder part with a perforating groove, and a sixth subassembly comprising a perforating cylinder having a first cylinder part with a perforating knife, said subsystems comprising a fourth subsystem comprising:

a fourth controlled position drive motor for driving said first cylinder of said fifth subassembly, and for driving said first cylinder part of said sixth subassembly, and a drive connection between said first cylinder part of said fifth subassembly and said first cylinder part of said sixth subassembly.

22. A drive system as in claim 21 wherein said subsystems further comprise a fifth subsystem comprising:

a fifth controlled position drive motor for driving a second cylinder part of said fifth subassembly which is rotatable coaxially with said first cylinder part of said fifth subassembly, and for driving a second cylinder part of said sixth subassembly which is rotatable coaxially with first cylinder part of said sixth subassembly, said second cylinder part of said fifth subassembly having a perforating knife, said second cylinder part of said sixth subassembly having a perforating groove with cooperates with said perforating knife of said second cylinder part of said fifth subassembly, and a drive connection between said second cylinder part of said fifth subassembly and said second cylinder part of said sixth subassembly.

23. A drive system as in claim 22 further comprising:

sensors for registering adjusting movements of one of said cylinder parts in each of said second through sixth subassemblies, and for generating input signals, a memory unit containing data, and a computer which processes said input signals and said data, and which generates output signals for said drive motors.

24. A drive system as in claim 20 further comprising:

sensors for registering adjusting movements of one of said cylinder parts in each of said second, third, and fourth subassemblies, and for generating input signals, a memory unit containing data, and a computer which processes said input signals and said data, and which generates output signals for said drive motors.

25. A drive system as in claim 13 further comprising controlled electronics which regulate and control said drive motors, said electronics exerting an active influence on oscillations which occur in said subsystems.

* * * * *